US007918101B2

(12) United States Patent
Sugiyama et al.

(10) Patent No.: US 7,918,101 B2
(45) Date of Patent: Apr. 5, 2011

(54) OUTDOOR UNIT OF AIR CONDITIONER

(75) Inventors: Shinji Sugiyama, Kanagawa (JP); Akihiko Nojima, Kanagawa (JP); Ryohei Kondo, Kanagawa (JP); Makoto Kamata, Kanagawa (JP); Ritsushi Taira, Kanagawa (JP)

(73) Assignee: Fujitsu General Limited, Kanagawa (JP)

( * ) Notice: Subject to any disclaimer, the term of this patent is extended or adjusted under 35 U.S.C. 154(b) by 165 days.

(21) Appl. No.: 11/220,914

(22) Filed: Sep. 8, 2005

(65) Prior Publication Data

US 2006/0130516 A1 Jun. 22, 2006

(30) Foreign Application Priority Data

Dec. 2, 2004 (JP) ..... P.2004-349844

(51) Int. Cl.
*F25D 23/12* (2006.01)

(52) U.S. Cl. ..... 62/259.1; 62/262; 62/263; 62/295; 62/298; 62/508

(58) Field of Classification Search ..... 62/262, 62/263, 259.1, 295, 298, 508
See application file for complete search history.

(56) References Cited

U.S. PATENT DOCUMENTS

| | | | | |
|---|---|---|---|---|
| 4,325,594 | A * | 4/1982 | Lang et al. | 312/100 |
| 4,800,734 | A | 1/1989 | Sauber et al. | |
| 5,184,879 | A * | 2/1993 | Brossardt et al. | 312/236 |
| 5,622,058 | A * | 4/1997 | Ramakrishnan et al. | 62/295 |
| 5,775,119 | A * | 7/1998 | Yamada et al. | 62/259.1 |
| 6,279,339 | B1 * | 8/2001 | Correa et al. | 62/262 |
| 6,357,247 | B1 * | 3/2002 | Moretti | 62/262 |
| 6,557,364 | B2 * | 5/2003 | Gunji et al. | 62/263 |
| 2005/0016194 | A1 * | 1/2005 | Park et al. | 62/262 |

FOREIGN PATENT DOCUMENTS

| | | | |
|---|---|---|---|
| CN | 1139751 | A | 1/1997 |
| CN | 2441060 | Y | 8/2001 |
| JP | 05 133562 | A | 5/1993 |
| JP | A 05-332576 | A | 12/1993 |
| JP | A 07-035921 | A | 2/1995 |
| JP | A 07-139762 | A | 5/1995 |
| JP | 08 166146 | A | 6/1996 |
| JP | 08 200740 | A | 8/1996 |
| JP | 8-278041 | | 10/1996 |
| JP | A 2000 274738 | A | 10/2000 |
| JP | 2003-156233 | | 5/2003 |

OTHER PUBLICATIONS

Office Action and English translation of Office Action from corresponding Chinese Application No. 200510099266.7 dated Aug. 1, 2008.

* cited by examiner

*Primary Examiner* — Henry Yuen
*Assistant Examiner* — Azim Rahim
(74) *Attorney, Agent, or Firm* — Venable LLP; Michael A. Sartori; Steven J. Schwarz

(57) ABSTRACT

A front panel constituted by a synthetic resin molded product is used with respect to a base panel, side panels, and a top panel which are formed of a metal, first retaining means for the side panels and second retaining means for the top panel are provided on the front panel to effect fixation.

9 Claims, 14 Drawing Sheets

OUTDOOR UNIT OF AIR CONDITIONER

This application claims priority based on Japanese Patent application no. 2004-349844, filed Dec. 2, 2004, the contents of which is incorporated herein by reference in its entirety. This priority claim is being made concurrently with the filing of the application.

TECHNICAL FIELD

The present invention relates to an outdoor unit of an air conditioner, and more particularly to making compatible a cost-lowering technology and a reinforcement technology thereof.

RELATED ART

Related art air conditioners include a split-type air conditioner in which an indoor unit and an outdoor unit are separated. The split-type air conditioner has advantages in that there is no need to provide a large hole in a wall as compared with the integral-type air conditioner, and in that there is no need to make use of a window frame.

As shown in JP-A-2003-156233, the outdoor unit of the air conditioner has a box-shaped outdoor unit body, and a compressor, a heat exchanger, a blower fan, and the like are provided in its interior, the outdoor unit being connected to an indoor unit through various cords, piping, and the like.

The outdoor unit body has a base panel installed horizontally on a contacted surface of the ground or a veranda. Provided uprightly on the base panel are a pair of left and right side panels, each formed in an L-shape for covering one side of the outdoor unit body and a portion of the front side, as well as a supply grille for covering an air blow port for the blower fan between these side panels. Further, the upper side is covered with a top panel. On the rear side of the base panel, a heat exchanger is installed, and a protection grille for covering the heat exchanger is provided.

Since the outdoor unit body is exposed to the sunshine, wind and weather, the outdoor unit body is required to have weather resistance and corrosion resistance. In addition, there are many cases where a flower pot, luggage, or the like is placed on the outdoor unit body, so that the outdoor unit body is required to have strength to support a load. Therefore, in the related art outdoor unit body, all the panels excluding the supply grille are formed of metal plates.

However, when these panels are formed of metal, heat treatment or coating treatment must be provided to obtain weather resistance and corrosion resistance, so that the number of manufacturing processes increases, resulting in higher manufacturing cost. In addition, since the panels are formed of metal, the outdoor unit body becomes heavy, so that the transportation and installation are troublesome.

Accordingly, to manufacture the outdoor unit body at a lower cost, it is possible to form these panels of a synthetic resin, but the following problems are encountered in the case where the outdoor unit body is formed of the synthetic resin. Namely, since the synthetic resin has a large coefficient of thermal expansion as compared with a metal, the synthetic resin expands or shrinks due the rise and fall of air temperature, and the distortion, a gap, or the like is likely to occur in the outdoor unit body.

When the distortion, the gap, or the like occurs in the outdoor unit body, there is a possibility of breakage of the main body or entry of water, possibly causing damage to a refrigeration cycle mechanism in the interior of the outdoor unit. Accordingly, in JP-A-2003-156233, to reduce the dimensional error due to thermal expansion as practically as possible, a relatively small area of only the supply grille covering the air blow port is made of a synthetic resin.

As another problem, with the outdoor unit disclosed in the JP-A-2003-156233, the side panels are formed in an L-shape to serve as portions of the front panel, when an electrically operated part or the like in the interior has failed, it is necessary to remove all of the top panel, the supply grille, and the side panels.

As another problem, the outdoor unit bodies are installed adjacent to wall surfaces of houses. Accordingly, when sparks leap to the outdoor unit in a fire or the like, the fire can possibly spread.

SUMMARY OF THE INVENTION

The present invention has been devised to overcome at least the above-described problems, and an object is to provide at low cost an outdoor unit of an air conditioner excelling in maintainability without causing its basic performance such as strength to decline. However, the present invention is not limited to this object, and need not solve this object, or any other object to be properly enabled. Further, the present invention may also solve other objects.

The invention has a number of features listed below. In accordance with a first aspect, there is provided an outdoor unit of an air conditioner comprising an outdoor unit body having therein a compressor, an electrical equipment box, a heat exchanger, and a blow fan, the outdoor unit body including a base panel which is installed on a contacted surface; a pair of left and right side panels provided uprightly on the base panel; a front panel installed on a front side of the outdoor unit body; and a top panel which is placed on upper end sides of the side panels and the front panel, wherein at least the side panels are formed of a metal, the front panel is constituted by a synthetic resin molded product, and a front end of each of the side panels is bent in a vicinity of a corner of the base panel.

In accordance with a second aspect, in the outdoor unit of an air conditioner according to the first aspect, an interior of the outdoor unit body is partitioned by a partition plate into a machine (i.e., first) chamber including the compressor and the electrical equipment box and a heat exchange (i.e., second) chamber including the heat exchanger and the blow fan, the front panel integrally has a supply grille for the blow fan and a decorative panel for covering the machine chamber, and first retaining means (i.e., a first retainer) is provided between each of the side panels and the front panel.

In accordance with a third aspect, in the outdoor unit of an air conditioner according to the second aspect, the first retaining means is constituted by a retaining pawl provided on either one of each of side ends of the front panel and each of the side panels and by a retained portion which is provided on another one thereof and on which the retaining pawl is caught, and an amount of clearance is provided between the retaining pawl and the retained portion.

In accordance with a fourth aspect, in the outdoor unit of an air conditioner according to any one of the first to third aspects, the width of the front panel is formed to be greater than the width of an opening between the side panels, and the front panel is retained such that a portion of the panel overlaps each of the side panels.

In accordance with a fifth aspect, in the outdoor unit of an air conditioner according to any one of the first to fourth aspects, an abutment surface opposing an end of each of the side panels is provided on the front panel with an amount of clearance with respect to the end of each of the side panels.

In accordance with a sixth aspect, in the outdoor unit of an air conditioner according to any one of the first to fifth aspects, second retaining means is provided between the front panel and the top panel.

In accordance with a seventh aspect, in the outdoor unit of an air conditioner according to the sixth aspect, the second retaining means is constituted by an insertion hole provided in either one of an upper end of the front panel and the top panel and by a retaining piece which is provided in another one thereof and is inserted into the insertion hole.

In accordance with an eighth aspect, in the outdoor unit of an air conditioner according to any one of the first to seventh aspects, a motor mounting base for supporting a fan motor of the blow fan is further provided uprightly on the base panel, and third retaining means is provided between the front panel and the motor mounting base.

In accordance with a ninth aspect, in the outdoor unit of an air conditioner according to the eighth aspect, the motor mounting base has a main frame provided uprightly on the base panel in such a manner as to extend substantially vertically and a reinforcing frame which has one end connected to the main frame and is formed along with and in parallel with the top panel, and a clamping portion serving as the third retaining means for clamping the upper end of the front panel is provided on another end side of the reinforcing frame.

In accordance with a tenth aspect, in the outdoor unit of an air conditioner according to the eighth or ninth aspect, a portion of the motor mounting base is further supported by the heat exchanger.

In accordance with an eleventh aspect, in the outdoor unit of an air conditioner according to any one of the eighth to 10th aspects, threaded holes are respectively provided coaxially in the motor mounting base, the front panel, and the top panel, and are integrally screwed down.

In accordance with a twelfth aspect, in the outdoor unit of an air conditioner according to any one of the ninth to 11th aspects, a retaining position of the second retaining means and a retaining position of the third retaining means overlap.

The present invention has various advantages. In accordance with the first aspect, as both ends of each side panel are bent in the vicinities of corners, it is possible to compensate for a decline in the strength of the front portion when the front panel is formed of a single synthetic resin.

In accordance with the second aspect, since the single front panel having the supply grille for the blow fan and the decorative panel for covering the machine chamber is formed of a synthetic resin, the front panel can be manufactured at low cost as compared with a metallic product. Furthermore, by simply removing the top panel and the front panel, it is possible to provide maintenance for electrical equipment, the blow fan, and the like in the interior.

In accordance with the third aspect, since the structure provided is such that the front panel and the side panels are held by being caught by the retaining pawls and the retained portions, the attachment and detachment of the front panel can be effected simply in one-touch operation.

Furthermore, since an amount of clearance is provided between the retaining pawl and the retained portion, it is possible to allow a dimensional difference due to the expansion and shrinkage of the front panel. Hence, it is possible to prevent the distortion of the panel.

In accordance with the fourth aspect, since the entire width of the front panel is formed to be greater than the width of the opening between the side panels, and the front panel is retained so as to overlap with the side panels, even if the front panel undergoes thermal expansion or shrinkage, no gap is formed between the front panel and each side panel. Hence, the appearance is excellent.

In accordance with the fifth aspect, since an abutment surface for an end of each of the side panels is provided on the front panel, and a clearance is provided there, it is possible to allow a dimensional error due to thermal expansion.

In accordance with the sixth and seventh aspects, since an insertion hole and a retaining piece, which serve as second retaining means, are provided between the upper end of the front panel and the top panel, it is possible to prevent the front panel from falling down to the inner side of the outdoor unit body. At the same time, it is possible to prevent vibrational noise from being produced from the front panel due to the vibration of the motor during the operation.

In accordance with the eighth aspect, since the motor mounting base for the fan motor is used as the third retaining means for retaining the front panel, it is possible to more reliably prevent the front panel from falling down to the inner side of the outdoor unit. Furthermore, since the motor mounting base can be held by the base panel and the front panel, the motor mounting base can be used in common irrespective of the size of the heat exchanger.

In accordance with the ninth aspect, since a clamping portion for clamping and supporting the front panel by a portion of the motor mounting base is provided in the center, the center of the front panel is supported, so that the dimensional error due to the thermal expansion can be set uniform on the left and right sides.

In accordance with the tenth aspect, since a portion of the motor mounting base is further supported by the heat exchanger, the motor mounting base can be fixed more securely, and the front panel can be fixed more firmly.

In accordance with the eleventh aspect, since the motor mounting base, the front panel, and the top panel are screwed down through the threaded holes at one location, the load applied to the respective parts can be distributed effectively, and the disassembly can be performed simply.

In accordance with the twelfth aspect, since the retaining position of the second retaining means and the retaining position of the third retaining means are made to overlap, it is possible to further improve the strength.

DETAILED DESCRIPTION OF THE PREFERRED EMBODIMENTS

Figure 1:
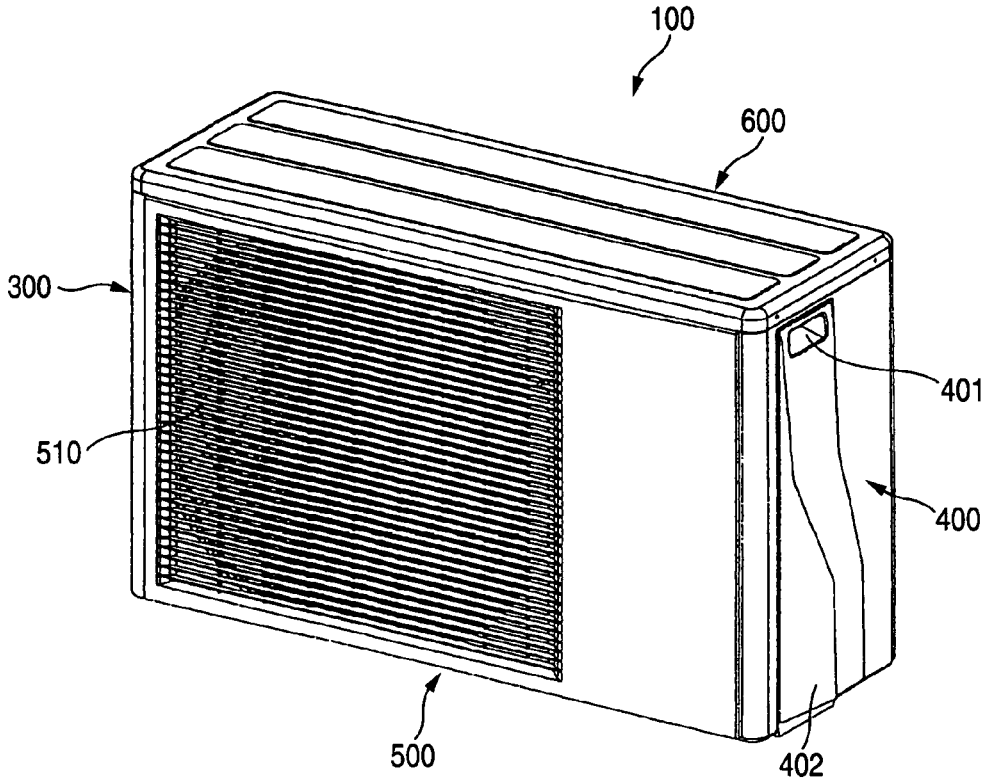
FIG. 1 is a perspective view of the appearance of an outdoor unit of an air conditioner in accordance with an exemplary, non-limiting embodiment.
Figure 2:
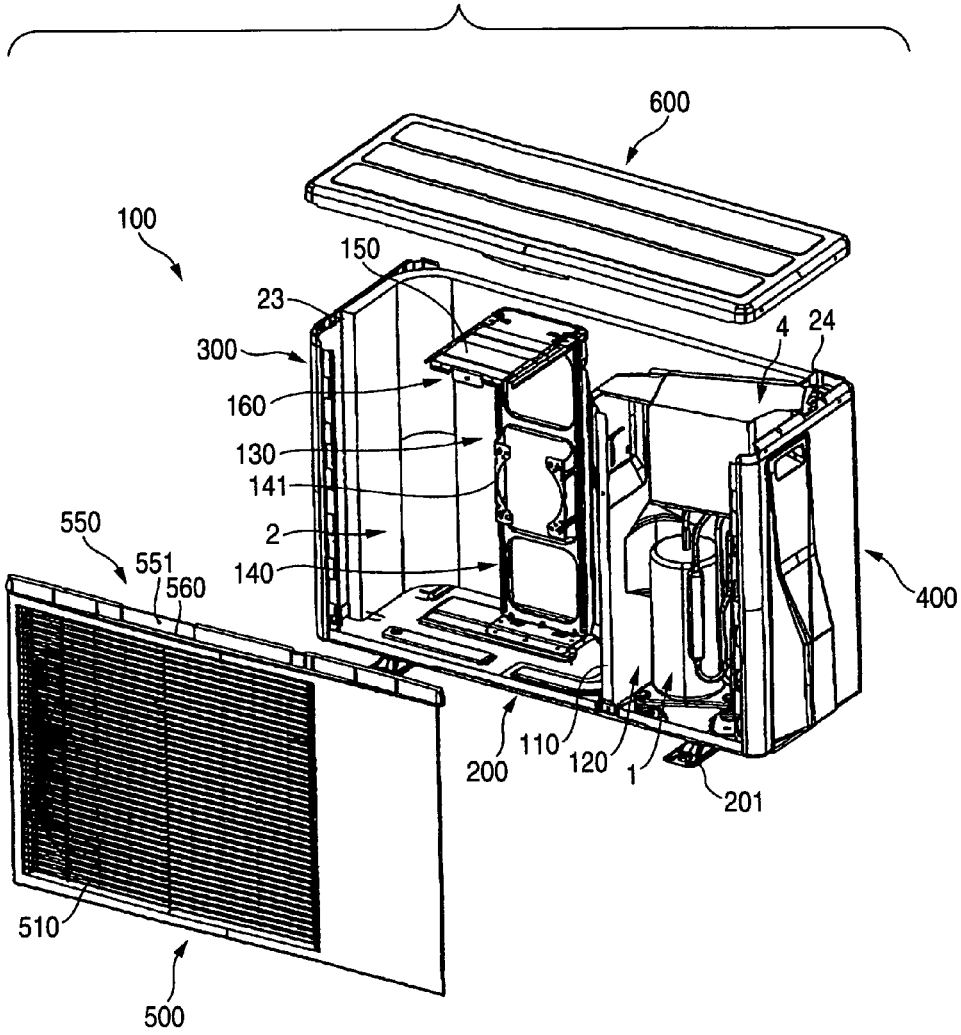
FIG. 2 is an exploded perspective view of an outdoor unit body in accordance with the exemplary, non-limiting embodiment.
Figure 3:
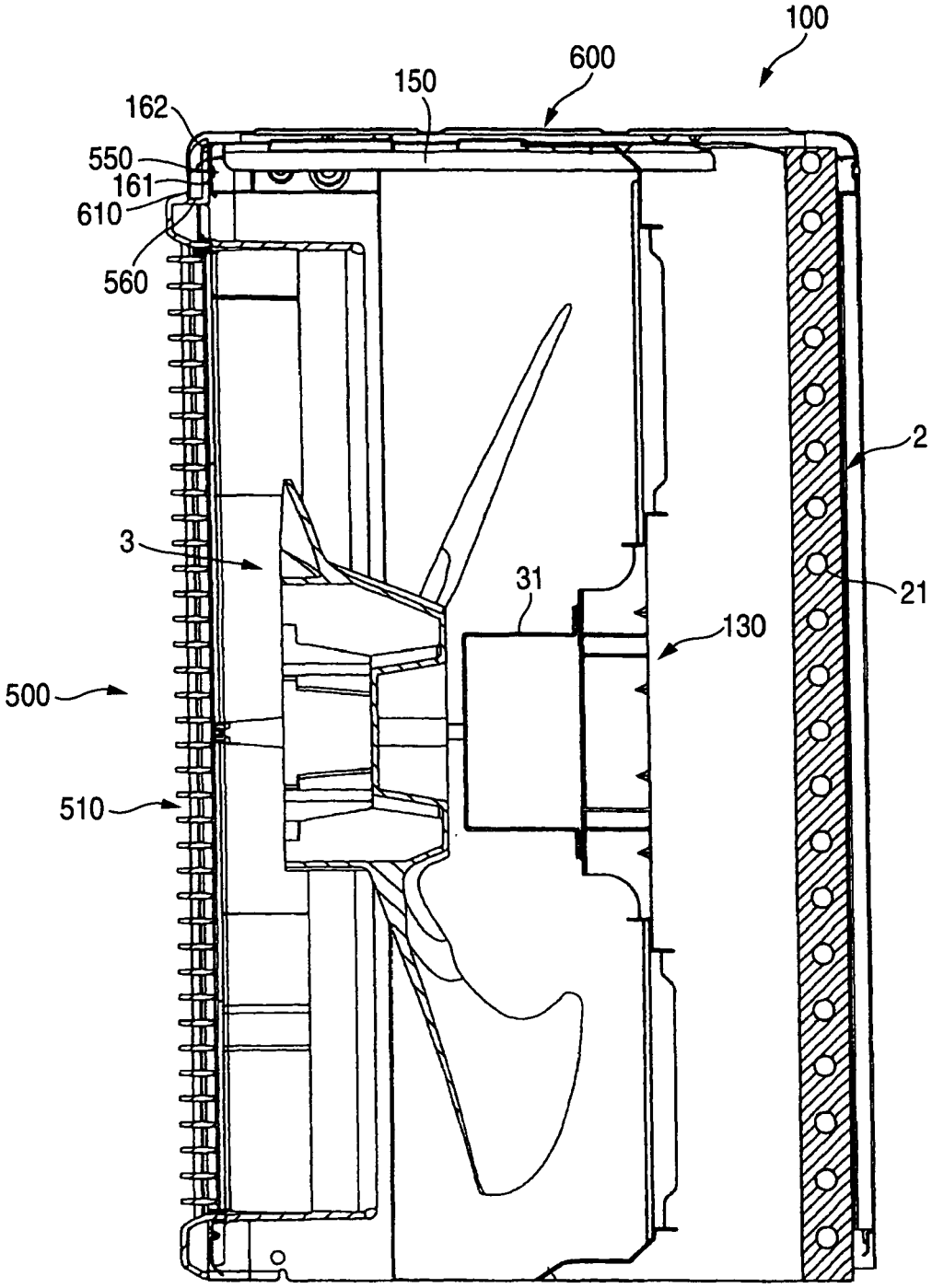
FIG. 3 is a vertical cross-sectional view of the outdoor unit body in accordance with the exemplary, non-limiting embodiment.
Figure 4:
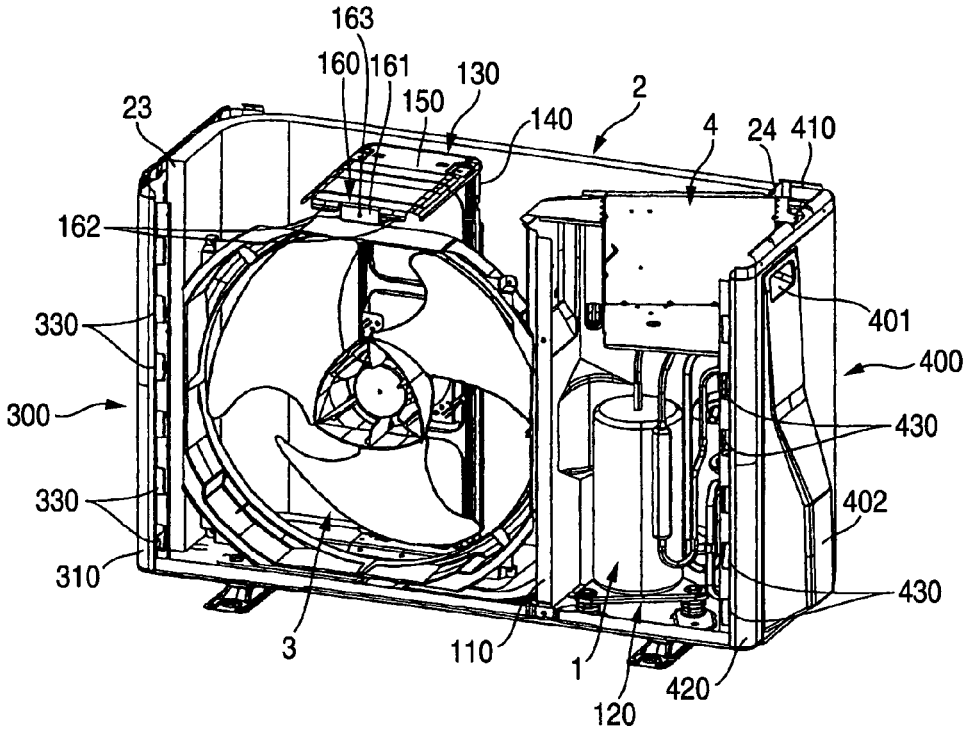
FIG. 4 is a perspective view schematically illustrating an internal structure of the outdoor unit body in accordance with the exemplary, non-limiting embodiment.

Next, referring to the drawings, a description will be given of an exemplary, non-limiting embodiment. FIG. 1 is a perspective view of an outdoor unit of an air conditioner in accordance with an exemplary, non-limiting embodiment. FIG. 2 is an exploded perspective view thereof. FIG. 3 is a vertical mid-sectional view. FIG. 4 is a perspective view illustrating an internal structure. A description will be given hereafter of only the outdoor unit, the indoor unit will not be illustrated, and a description will be omitted. The indoor unit is well-known in the art, and any indoor unit as would be known by one of ordinary skill in the art could be used.

The air conditioner outdoor unit has a box-shaped outdoor unit body 100, and a compressor 1, a heat exchanger 2, and a blower fan 3 (see FIG. 4), which are included in the refrigeration cycle, as well as an electrical equipment box 4 as a control system therefor, are accommodated in the outdoor unit body 100.

As shown in FIG. 2, an accommodation space (machine, or first, chamber) 120 partitioned by a partition plate 110 is provided in the outdoor unit body 100, and the compressor 1 and the electrical equipment box 4 are disposed in this accommodation space 120. A second chamber is also provided, which includes the heat exchanger and the blow fan.

As shown in FIG. 2, the heat exchanger 2 is formed in an L-shape and extends along the rear side of the outdoor unit body 100 and a side thereof The heat exchanger 2 may be a well-known heat exchanger, in which a refrigerant pipe 21 is routed in a multiplicity of parallel fins 22 in a zigzag form. Both end portions of the refrigerant pipe 21, which are bent in the form of a hairpin, are supported by being formed as side plates 23 and 24. The side plate 23 is a guide for assembling the outdoor unit body 100.

In this exemplary, non-limiting embodiment, although the heat exchanger 2 is formed integrally in the L-shape, the heat exchanger 2 may be split into a rear heat exchanger unit and a side heat exchanger unit, and these units may be connected integrally in the L-shape. The specific construction of the heat exchanger 2 is well-known in the art, and any heat exchanger as would be known by one of ordinary skill in the art could be used.

As shown in FIG. 4, the blow fan 3 includes an axial fan that sucks air from the rear side of the outdoor unit body 100 and blows the sucked air toward the front side. As shown in FIG. 3, a fan motor 31 for driving the blow fan 3 is provided on the rear side (right side in FIG. 3) of the blow fan 3. The blow fan 3 is supported by a motor mounting base 130 as described below.

Figure 7:
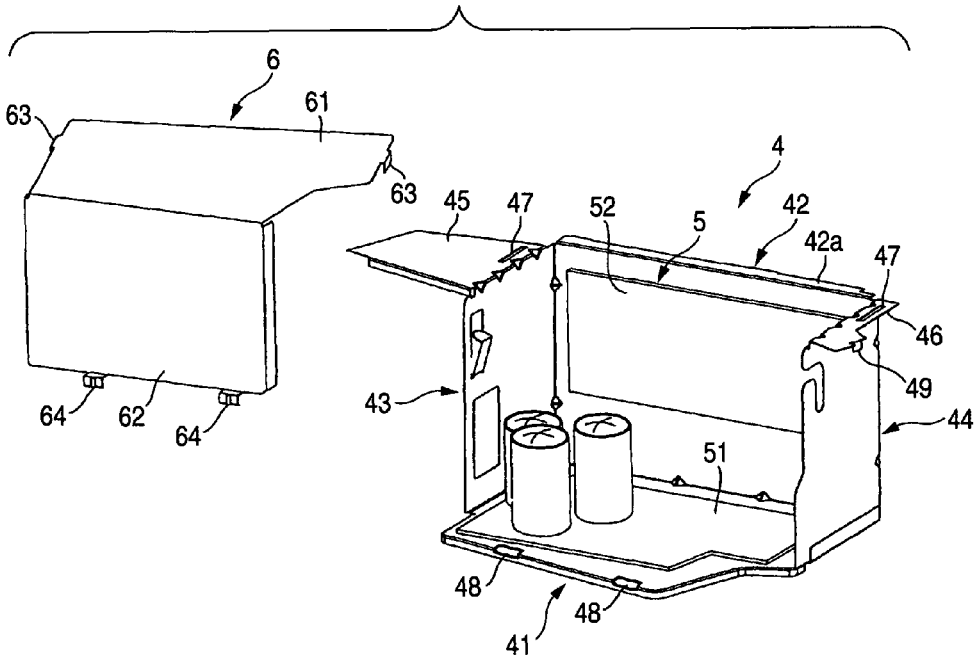
FIG. 7 is an exploded perspective view of an electrical equipment box in accordance with the exemplary, non-limiting embodiment.
Figure 8:
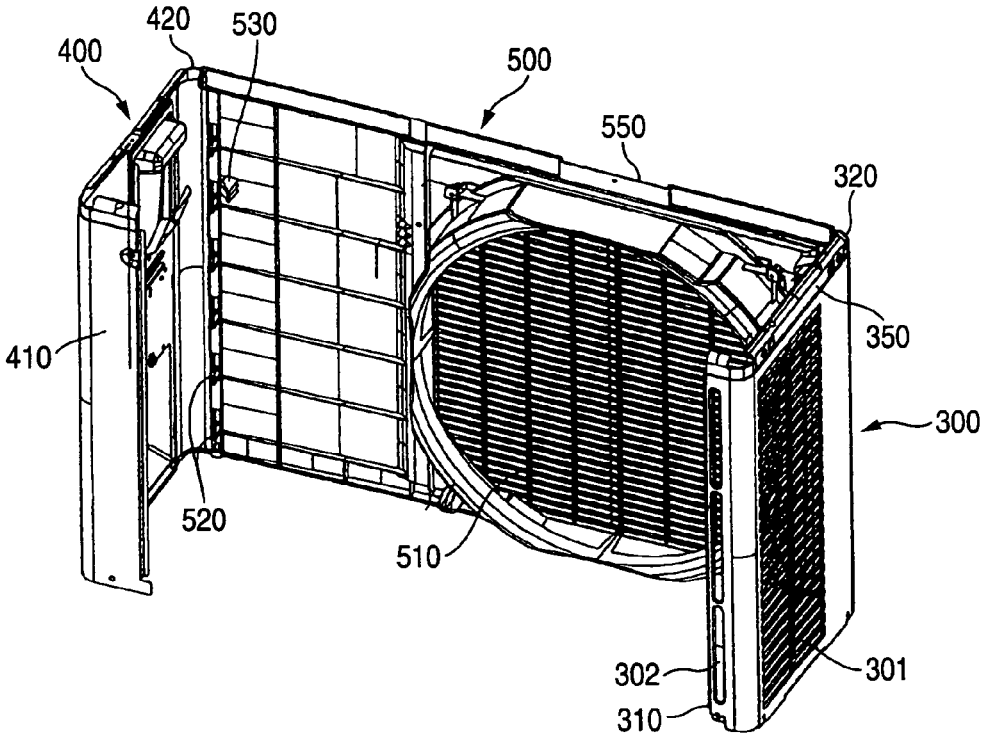
FIG. 8 is a rear perspective view of a state in which a side panel and the front panel are assembled in accordance with the exemplary, non-limiting embodiment.

Referring to FIG. 2, the electrical equipment box 4 is provided on the upper side of the compressor 1 inside the accommodating space 120, and its opening is covered by a detachable box cover 6. As shown in FIG. 7, the electrical equipment box 4 is formed by bending a bendable (e.g., metal) plate of such as stainless steel (but not limited thereto), and electrical equipment 5 including a power source and a control board of the air conditioner is accommodated in its interior.

The electrical equipment box 4 includes a bottom plate 41 on which a power supply board 51 is mounted, a back plate 42 on which a control board 52 is mounted, and a pair of side plates 43 and 44 that cover the sides of the bottom plate 41 and the back plate 42.

A retaining flange 42*a* disposed along an upper end surface of the partition plate 110 is provided on an upper end of the back plate 42. Retaining flanges 45 and 46 disposed along the upper end surface of the partition plate 110 are respectively formed on the side plates 43 and 44.

A pair of first insertion holes 47, into which a pair of first retaining ribs 63 of the box cover 6 are respectively inserted, are respectively formed in the retaining flanges 45 and 46. A pair of second insertion holes 48, into which a pair of second retaining pieces (e.g., ribs) 64 of the box cover 6 are respectively inserted, are formed in a frontal end of the bottom plate 41.

A temporarily fixing rib 49, which is inserted into a temporarily fixing insertion hole 450 of a right side panel 400 described below, is formed on one retaining flange 46. The temporarily fixing rib 49 is constituted by a tongue piece vertically bent from an end portion of the temporarily fixing flange 46.

The box cover 6 is similarly formed by bending a bendable (e.g., metal) plate, and is formed in an L-shape including an upper cover 61 for covering an upper opening of the electrical equipment box 4.

The pair of first retaining ribs 63, which are inserted into the pair of first insertion holes 47, are respectively provided on both end sides of the upper cover 61. The pair of second retaining pieces (e.g., ribs) 64, which are inserted into the pair of second retaining holes 48, are formed on a lower end side of the front cover 62. The number of these ribs is exemplary, and any number of ribs, as would be known by one skilled in the art, could be substituted for the above-described ribs.

In this exemplary, non-limiting embodiment, the second retaining ribs 64 are provided uprightly so as to extend in an L-shape from a lower end of the front cover 62. Namely, as the first retaining ribs 63 are released from the first insertion holes 47, and the box cover 6 is rotated in a frontal direction by using the second retaining ribs 64 as axes, the interior of the electrical equipment box 4 can be viewed from the front side with the box cover 6 remaining on the electrical equipment box 4.

According to this arrangement, even when there is no space between a ceiling surface and a top surface of the outdoor unit, such as when an outdoor unit used for a veranda of a condominium is held by being suspended from the ceiling surface, the interior of the electrical equipment box 4 can be viewed from the front side. As such, it is possible to perform the maintenance operation of the electrical equipment 5 without bringing down the outdoor unit body 100 on each such occasion.

Referring to FIGS. 1 and 2, the outdoor unit body 100 includes a base panel 200 installed on the contacted surface; a pair of left and right side panels 300 and 400 respectively, positioned upright on the base panel 200; a front panel 500 installed and positioned on the front side of the outdoor unit body 100; and a top panel 600 placed on upper end sides of the side panels 300 and 400 and the front panel 500.

The base panel 200, the side panels 300 and 400, and the top panel 600 can be formed by press forming a steel plate of such as stainless steel. Coating treatment, such as rust-preventing treatment, can be provided on the surface of each panel. However, the foregoing formation and treatment methods are merely exemplary, and any other method that would be known by one skilled in the art could be used instead.

The base panel 200 is a rectangular pan in which peripheral edges are bent substantially vertically toward the top. A pair of leg portions 201, installed on the contacted surface, are provided on the bottom of the base panel 200. Mounting bushes for fixing the compressor 1, the heat exchanger 2, and the like are formed on the base panel 200.

Unillustrated threaded holes for mounting are formed in rising portions on both sides of the base panel 200, and lower end sides of the side panels 300 and 400 are screwed down through these threaded holes.

Figure 6:
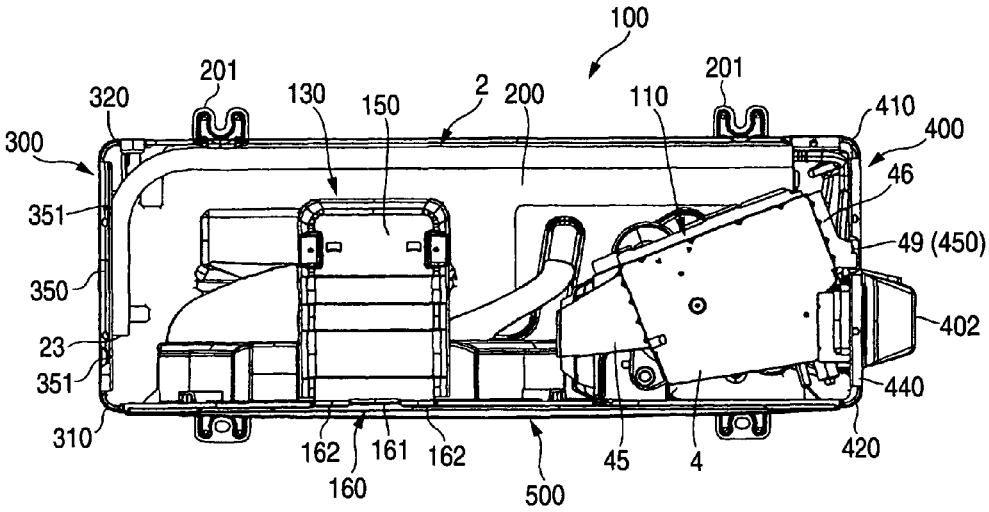
FIG. 6 is a plan view of a state in which a top panel of the outdoor unit body is removed in accordance with the exemplary, non-limiting embodiment.

The partition plate 110 is provided upright on the base panel 200. Referring to FIG. 6, the partition plate 110 is a U-shaped frame provided upright so as to extend substantially vertically from the bottom of the base panel 200 up to a height, and is installed on the right front side of the base panel such that its open side faces the front, As shown in FIG. 2, the motor mounting base 130 for supporting the blow fan 3 is provided upright on the base panel 200. The motor mounting base 130 includes a main frame 140 having one end fixed to the base panel 200 and the other end provided upright so as to extend substantially vertically toward the top panel 600, as well as a reinforcing frame 150 formed so as to extend from an upper end of the main frame 140 toward the front panel 500 along with and in parallel with the top panel 600. These frames are formed in an inverse L-shape.

The main frame 140 includes a metal frame formed in a ladder shape. A motor mounter 141, to which the fan motor 31 is fixed, is formed substantially in its center. The fan motor 31 is attached to this motor mounter 141 (see FIG. 2).

A portion of the rear side of the main frame 140 may be fixed to the heat exchanger 2. Namely, as the main frame 140 and the heat exchanger 2 are fixed to each other, the motor mounting base 130 can be fixed more firmly, and the load can be effectively relieved when the load is applied to the front panel 500 described below.

The reinforcing frame 150 is formed of a metallic plate member having substantially the same width as that of the main frame 140. The reinforcing frame 150 is attached (e.g., screwed down) to the main frame 140. A clamping portion 160 for clamping the front panel 500 is provided on the frontal end side (front panel 500 side) of the reinforcing frame 150. However, as the clamping portion 160, any retainer as would be known by one skilled in the art may be used.

As shown in FIG. 4, the clamping portion 160 includes an abutment plate 161 disposed on the rear side of the front panel 500, as well as a pair of clamping plates 162 on the front side of the front panel 500. The abutment plate 161 is a tongue piece bent vertically downward from the center at the frontal end of the reinforcing frame 150, and a threaded hole 163 is formed in its center. The threaded hole 163 is formed at a position coaxial with a threaded hole 551 in the front panel 500.

The clamping plates 162 are tongue pieces formed in an inverse L-shape on both left and right sides of the abutment plate 161 by being bent downward from the frontal end of the reinforcing frame 150, and their distal ends are bent inwardly to resiliently clamp the front panel 500.

Figure 5:
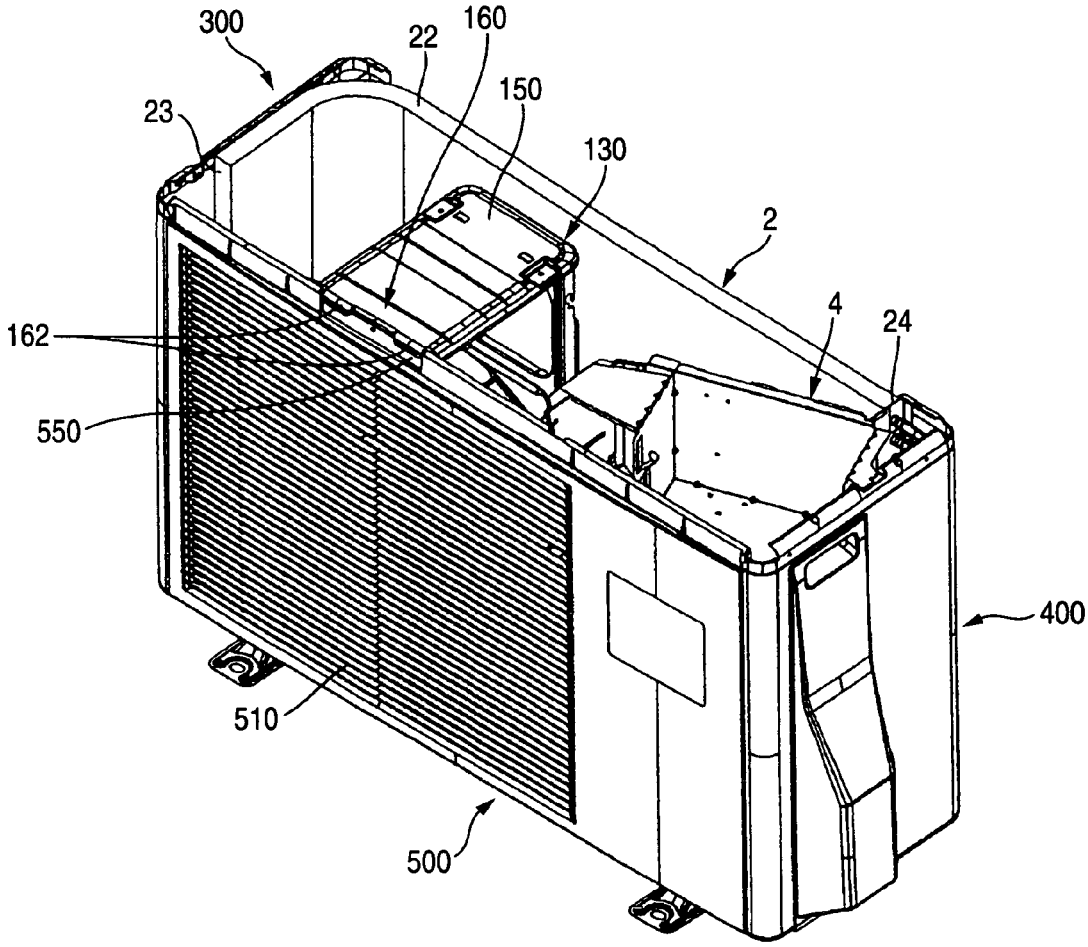
FIG. 5 is a perspective view illustrating a state in which a front panel is clamped by a portion of a motor mounting base in accordance with the exemplary, non-limiting embodiment.

According to this arrangement, as shown in FIG. 5, the structure provided is such that if the front panel 500 is clamped and held between the abutment plate 161 and the clamping plates 162, the motor mounting base 130 is held by the base panel 200 and the front panel 500. Since the supporting structure using the heat exchanger 2, which has been the case in the related art, is not provided, it is unnecessary to replace the motor mounting base 130 depending on a change in the size of the heat exchanger 2.

In this exemplary, non-limiting embodiment, the motor mounting base 130 may be arranged to clamp an upper end side of the front panel 500, the motor mounting base 130 may alternatively be structured to clamp the rear side of the front panel 500. Namely, the motor mounting base 130 can be supported by the front panel 500.

Next, referring to FIGS. 4, 8, and 10 to 12, a description will be given of one side panel 300 (hereafter referred to as the left side panel 300). The left side panel 300 is a single metal plate for covering the left side of the outdoor unit body 100, and bent portions 310 and 320, which are bent in a curved manner to substantially conform to respective corners of the base panel 200, are integrally formed at both ends.

A side air intake grille 301 is formed in the left side panel 300 for introducing air toward the heat exchanger 2 that is bent on the left side. The bent portion 310 is formed to cover the corner formed by the left side and the rear side, and a portion of the side air intake grille 301 is also formed in the bent portion 310.

The other bent portion 320 covers the corner formed by the left side and the front side. Retaining holes 330 serving as a first retaining means for retaining the front panel 500 are provided in the bent portion 320. These bent portions 310 and 320 also function as reinforcing ribs for compensating for a decline in the strength of the outdoor unit body 100 due to the fact that the front panel 500 is formed of a synthetic resin.

As shown in FIG. 4, the retaining holes 330 are provided at intervals along the vertical direction of the left side panel 300. The retaining holes 330 should preferably be formed with amounts of clearance in their longitudinal direction and their transverse direction, respectively.

Figure 14:
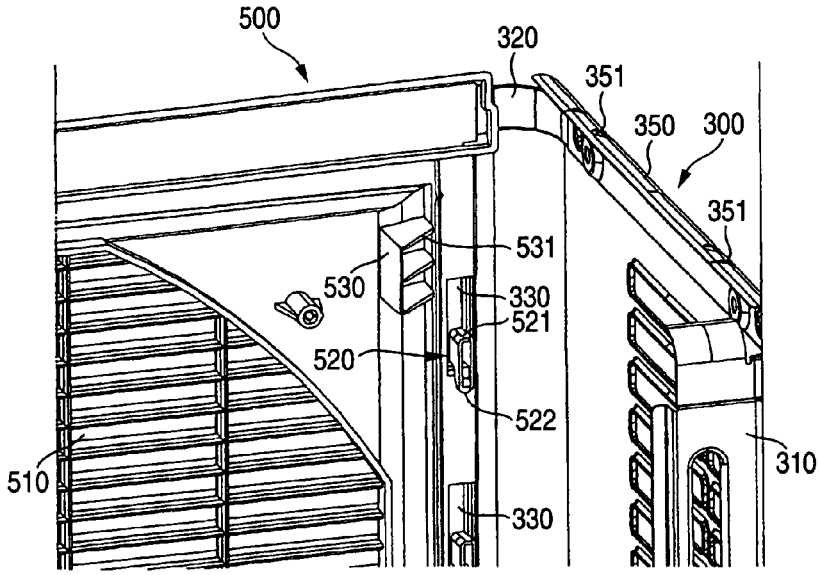
FIG. 14 is a rear perspective view illustrating a state in which the front panel is retained by the left side panel in accordance with the exemplary, non-limiting embodiment.

As shown in FIG. 14, a retaining pawl 520 formed on the front panel 500 is retained in each retaining hole 330. At this time, since the front panel 500 is a synthetic resin molded product, its coefficient of thermal expansion is large in comparison with a metal. Accordingly, unless some clearance is provided, there is a possibility of the front panel 500 becoming distorted due to thermal shrinkage or thermal expansion.

Accordingly, by providing a clearance within a range allowing a dimensional error due to the difference in the coefficient of thermal expansion, it is possible to reliably prevent the distortion of the front panel 500 due to expansion or shrinkage.

Figure 10:
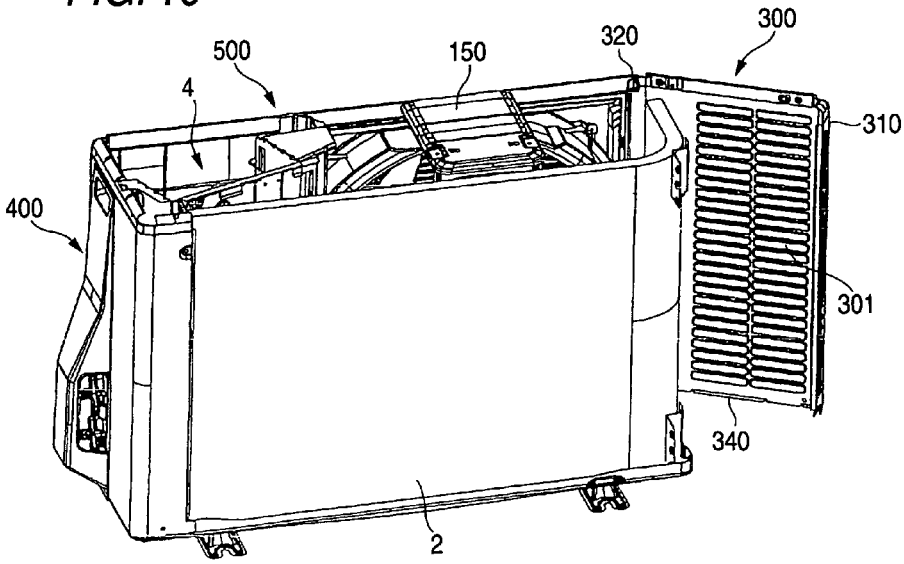
FIG. 10 is an exploded perspective view of a state in which a left side panel is removed from the outdoor unit body in accordance with the exemplary, non-limiting embodiment.

As shown in FIG. 10, a supporting rib 340 is provided at a lower end side of the left side panel 300. The supporting rib 340 is adapted to be caught by a side end of the base panel 200 when the left side panel 300 is fixed to the base panel 200.

Figure 11:
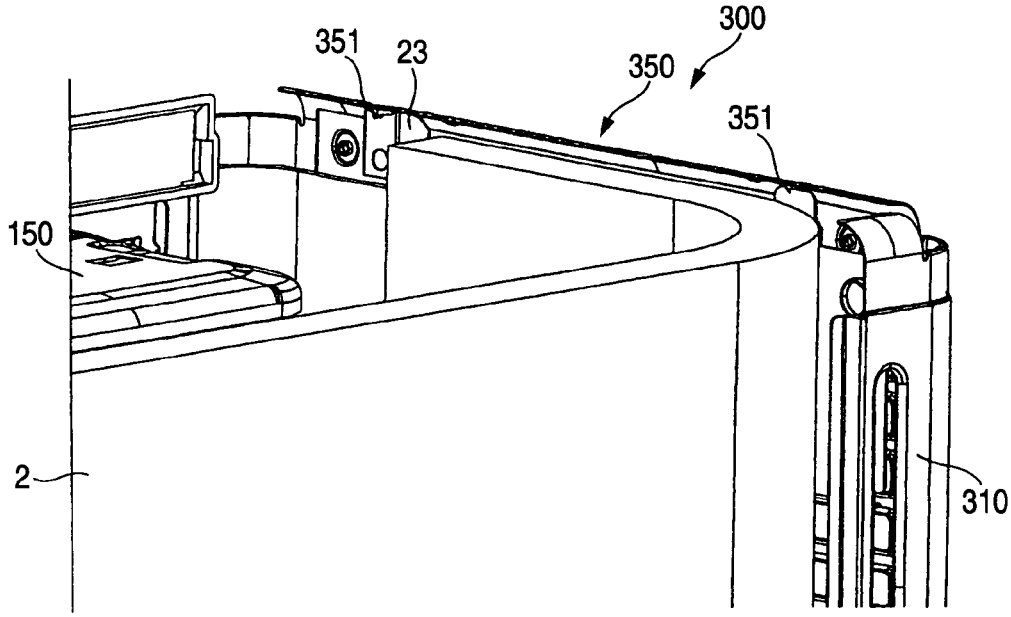
FIG. 11 is a partially enlarged view illustrating a state in which the left side panel is temporarily fixed to a heat exchanger in accordance with the exemplary, non-limiting embodiment.
Figure 12:
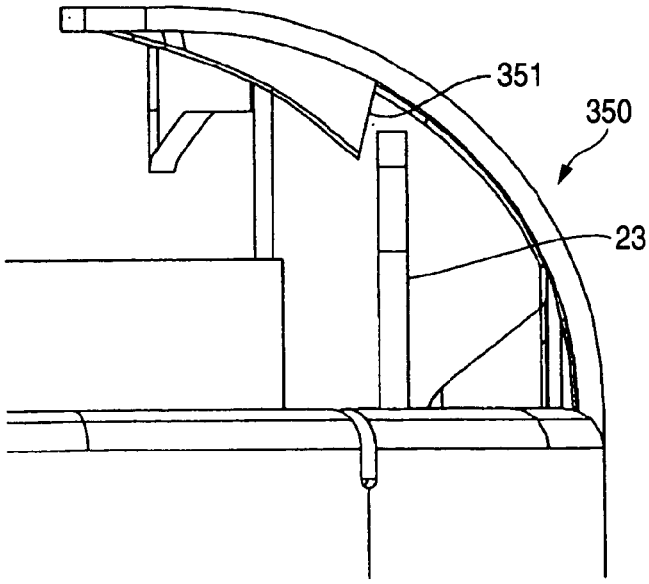
FIG. 12 is a partially enlarged side view of a temporarily fixed state in accordance with the exemplary, non-limiting embodiment.

As shown in FIGS. 11 and 12, a guide rib 350 is provided at an upper end of the left side panel 300 for guiding the top panel 600 when the top panel 600 is installed. The guide rib 350 is provided uprightly in an arcuate shape so as to be curved inwardly from the upper end of the left side panel 300. The edge of the top panel 600 is adapted to be guided along this arcuate surface.

The guide rib 350 is further provided with a temporarily fixing means for temporarily fixing the left side panel 300 at the time of assembling the left side panel 300. In this example, the temporarily fixing means is constituted by retaining hooks 351 formed on the inner side of the guide rib 350.

Each retaining hook 351 is constituted by a pawl projectingly provided to extend downwardly from an inner wall surface of the guide rib 350. As this retaining hook 351 catches the upper end of the side plate 23 of the heat exchanger 2, the left side panel 300 can be fixed temporarily.

In this exemplary, non-limiting embodiment, two retaining hooks 351 are provided in the front and in the rear of the guide rib 350. The front (front side) retaining hook 351 catches the side plate of the L-shaped heat exchanger 2, while the rear (rear side) retaining hook 351 catches the side plate when an I-shaped heat exchanger is used. According to this arrangement, it is possible to cope with a change in the capacity of the heat exchanger 2.

Figure 13A:
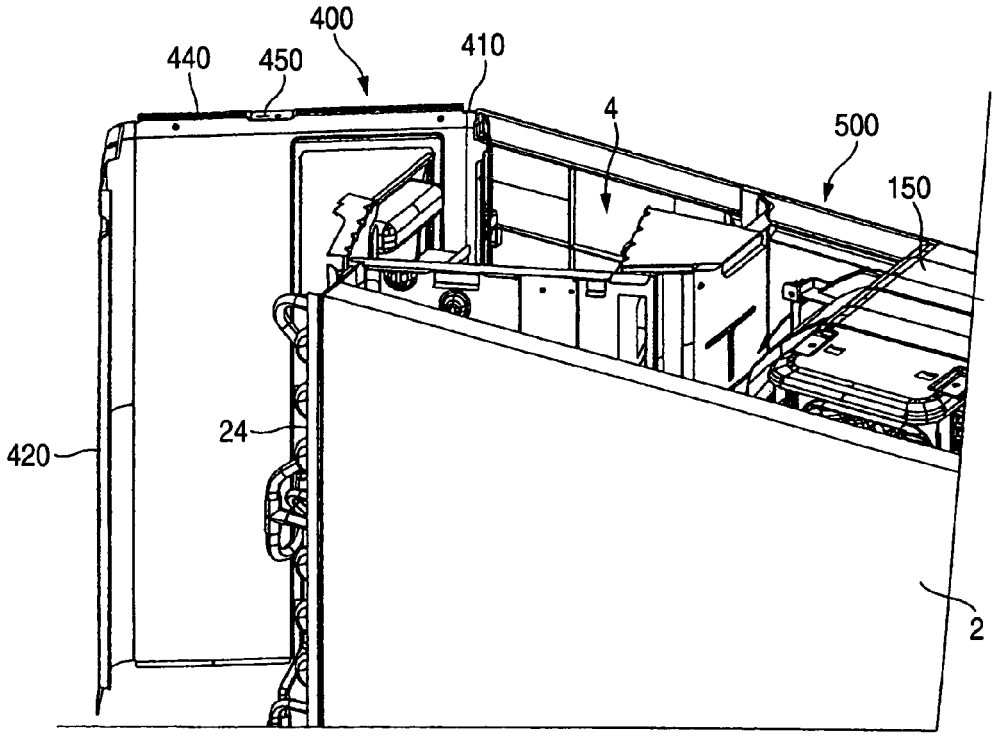
FIG. 13A is an exploded perspective view of a state in which a right side panel is removed from the outdoor unit body in accordance with the exemplary, non-limiting embodiment.

As shown in FIGS. 4 and 13A, the right side panel 400 is a single metal plate for covering the right side of the outdoor unit body 100. Bent portions 410 and 420, which are bent in a curved manner to conform to respective corners of the base panel 200, are integrally formed at its ends.

The right side panel 400 is provided with a grip 401 for lifting the outdoor unit body 100. The grip 401 includes a recessed portion formed in the center of an upper side of the right side panel 400.

The right side panel 400 is further provided with a connecting section 402 for connecting various pipings and cords for connecting the outdoor unit and the indoor unit. The connecting section 402 juts out outward, and its lower end side is open for leading out the pipes and the like.

The bent portion 410 is curved along the corner formed by the right side and the rear side of the base panel 200. The other bent portion 420 is curved along the corner formed by the right side and the front side of the base panel 200.

Retaining holes 430 serving as one first retaining means for retaining the front panel 500 are provided in the bent portion 420. As shown in FIG. 4, the retaining holes 430 are provided at intervals along the vertical direction of the right side panel 400. These bent portions 410 and 420 function as reinforcing ribs for compensating for a decline in strength due to the fact that the front panel 500 is formed of a synthetic resin.

Figure 15:
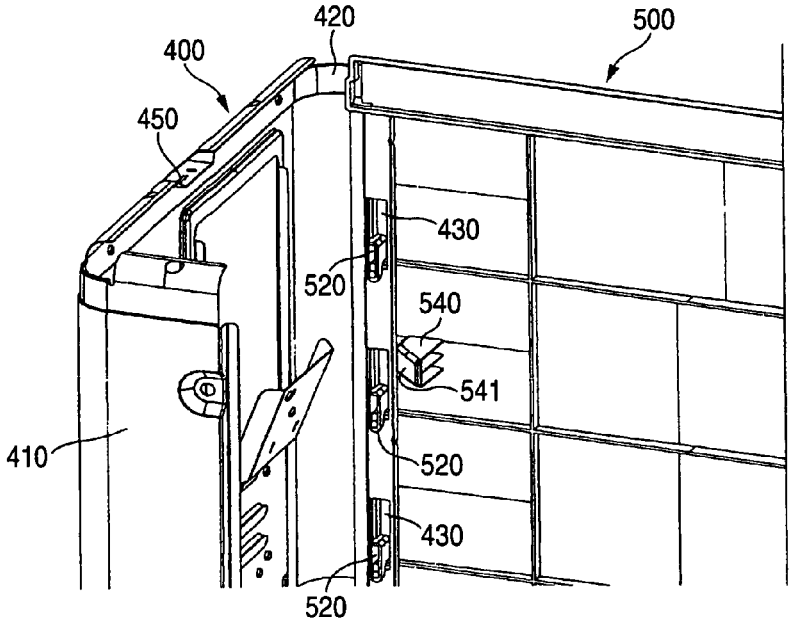
FIG. 15 is a rear perspective view illustrating a state in which the front panel is retained by the right side panel in accordance with the exemplary, non-limiting embodiment.

As shown in FIG. 15, the retaining holes 430 are caught by the retaining pawls 520 formed on the front panel 500. Since the retaining holes 430 in the right side panel 400 and the retaining holes 330 in the left side panel 300 have substantially the same shapes, a description of specific shapes and clearances is omitted for the sake of brevity.

As shown in FIG. 13A, a guide rib 440 is provided on the upper end of the right side panel 400, and the guide rib 440 is formed in an arcuate shape so as to be curved inwardly from the upper end of the right side panel 400. The edge of the top panel 600 is guided along this arcuate surface.

Figure 13B:
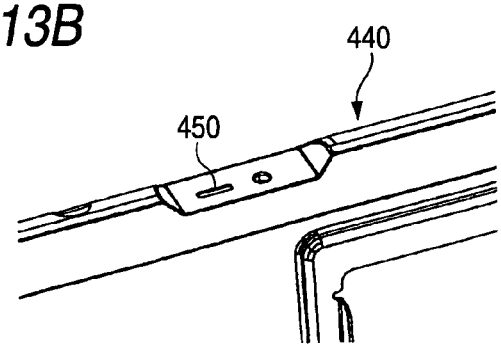
FIG. 13B is a partially enlarged perspective view of an upper end portion of the right side panel in accordance with the exemplary, non-limiting embodiment.

As shown in FIG. 13B, the temporarily fixing insertion hole 450 for temporarily fixing the right side panel 400 at the time of assembling the right side panel 400 is provided in the guide rib 440. The temporarily fixing insertion hole 450 is constituted by a so-called slit hole. The temporarily fixing rib 49, of the electrical equipment box 4 installed on the partition plate 110, is inserted into this temporarily fixing insertion hole 450 (see FIG. 6).

The front panel 500 is molded from a synthetic resin constituted by, for example but not by way of limitation, weather-resistant polypropylene. The front panel 500 is formed of weather-resistant polypropylene, but may alternatively be formed of a functional resin provided with a functional feature by the addition of an additive such as a flame retardant, or any equivalent thereof as would be known by one of ordinary skill in the art.

Figure 9:
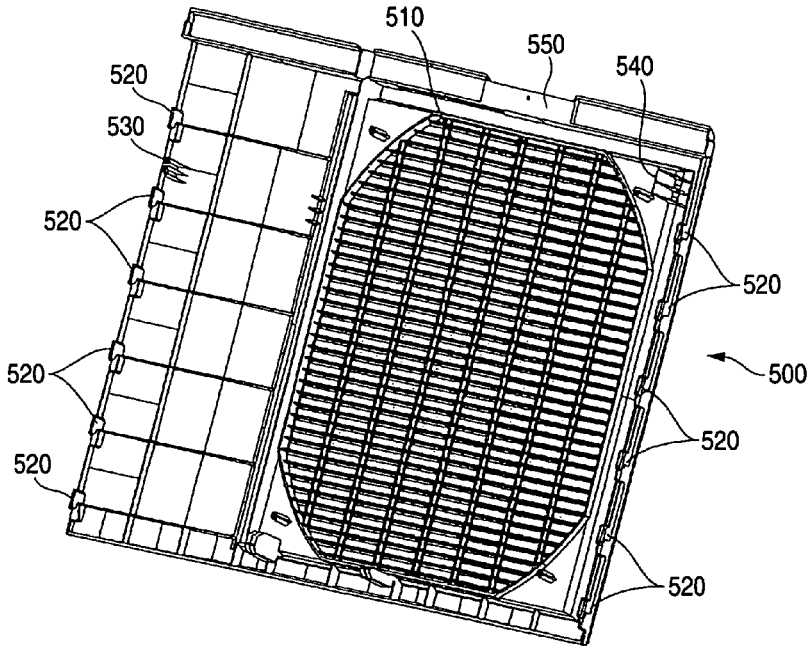
FIG. 9 is a rear perspective view of the front panel in accordance with the exemplary, non-limiting embodiment.

As shown in FIGS. 2 and 9, an air discharge grille 510 for the blower fan 3 in the outdoor unit body 100 is integrally formed in the front panel 500. The air discharge grille 510 is formed in the shape of louvers and is slightly larger than the diameter of the blow fan 3. Further, this front panel 500 also functions as a decorative panel for covering and concealing the machine chamber 120. The entire front side of the outdoor unit body 100 is thereby covered and concealed by a single panel.

Figure 16:
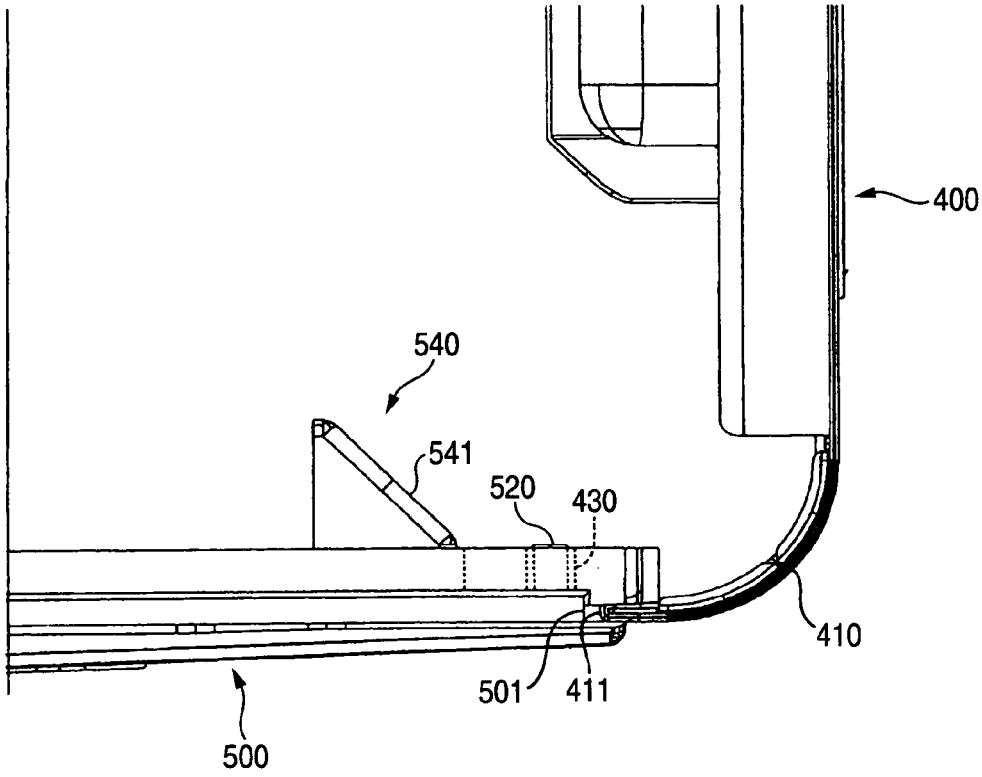
FIG. 16 is a partially enlarged plan view of a state of retention between the right side panel and the front panel in accordance with the exemplary, non-limiting embodiment.

FIG. 16 is a plan view in which the state of retention between the front panel 500 and the right side panel 400 is viewed from the top. The front panel 500 is formed such that its maximum width is greater that the opening width between the side panels 300 and 400, and is retained such that portions of the front panel 500 overlap the respective side panels 300 and 400.

In addition, an abutment surface 501 opposing an end 411 of each side panel is provided on the front panel 500 with an amount of clearance with respect to the end 411 of each side panel.

According to this arrangement, even if the widthwise dimension of the front panel 500 changes due to thermal expansion or shrinkage, since the front panel 500 overlaps, substantially no change is noted in the appearance of the front side. In addition, since a clearance is provided between the front panel 500 and each of the side panels 300 and 400, it is possible to absorb the dimensional difference due to the thermal expansion and shrinkage.

In this exemplary, non-limiting embodiment, only the relationship between the front panel 500 and the side panel 400 is illustrated by way of the clearance. A similar clearance is provided between the abutment surface 501 and the other side panel 300, and the front panel 500 is retained in a state of overlapping the side panel 300.

The plurality of retaining pawls 520 for retaining the front panel 500 on the respective side panels 300 and 400 are provided at both ends (both left and right ends in FIG. 9) on the rear side of the front panel 500. In this exemplary, non-limiting embodiment, a total of 12 retaining pawls 520, i.e., six on the left side surface and six on the right side surface, are provided.

Referring to FIG. 14, each retaining pawl 520 is formed in an inverse L-shape integrally having a proximal end portion 521 uprightly provided orthogonally from the reverse surface of the front panel 500 as well as a pawl portion 522 formed downwardly from a distal end of the proximal end portion 521 along the front panel 500.

As shown in FIG. 9, guide ribs 530 and 540 are provided on the reverse surface of the front panel 500 for guiding the widthwise fitting position of the front panel 500 when it is fitted to the side panels 300 and 400.

Referring to FIG. 14, the one guide rib 530 is projectingly provided adjacent to a left side end of the front panel 500, and is provided with a tapered surface 531 inclined from the outer side toward the inner side. As shown in FIG. 15, the other guide rib 540 is projectingly provided adjacent to a right side end of the front panel 500, and is provided with a tapered surface 541 inclined from the outer side toward the inner side.

According to this arrangement, when the front panel 500 is fitted to the side panels 300 and 400, if the widthwise position of the front panel 500 is offset, portions of the ends of the side panels 300 and 400 abut against the guide ribs 530 and 540, and are guided to proper fitting positions along the tapered surfaces 531 and 541.

Referring to FIGS. 2 and 3, a clamping surface 550 clamped by the clamping portion 160 of the motor mounting base 130 is provided at an upper end portion of the front panel 500. The clamping surface 550 is provided on a substantially upper end side in the center of the front panel 500, and is a recessed surface which is lower than the remaining portions in a thickness dimension.

The threaded hole 551 is provided in the clamping surface 550. This threaded hole 551 assumes a coaxial position with respect to the threaded hole 163 in the aforementioned clamping portion 160. As these threaded holes 163 and 551 are integrally secured by a screw, it is possible to firmly fix the front panel 500.

An insertion groove 560, into which a reinforcing piece 610 provided on a portion of the top panel 600 is inserted, is formed in a heightwise bottom portion of the clamping surface 550. As shown in FIG. 3, the insertion groove 560 is a groove open toward the upper end side of the front panel 500, and has a length in the widthwise direction.

According to this arrangement, as shown in FIG. 3, as the reinforcing piece 610 is inserted into the insertion groove 560, it is possible to press the front panel 500 by the top panel 600 so that the front panel 500 does not produce abnormal noise due to the vibration occurring when the fan motor 31 is driven.

Figure 17A:
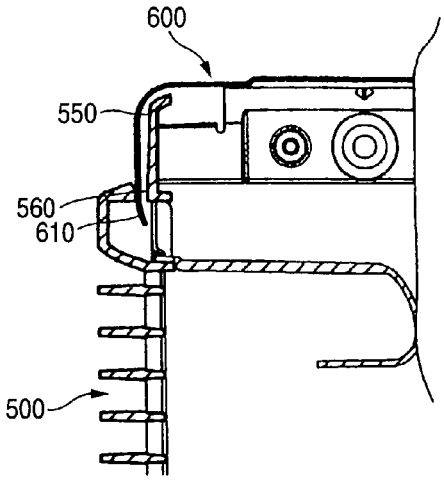
FIGS. 17A and 17B are partially enlarged cross-sectional views illustrating modifications of the state of retention between the right side panel and the front panel in accordance with the exemplary, non-limiting embodiment.
Figure 17B:
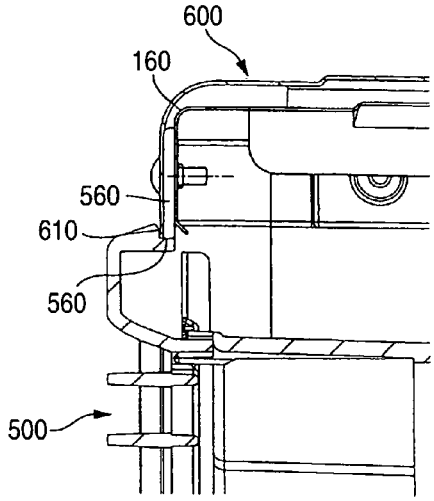

In this exemplary, non-limiting embodiment, the insertion groove 560 is a groove having a depth, but may alternatively be an insertion through hole extending in the heightwise direction, as shown in FIG. 17A. Still alternatively, as shown in FIG. 17B, a threaded hole may also be provided in a portion of the reinforcing piece 610 of the top panel 600, and the reinforcing piece 610, the clamping surface 550, and the clamping portion 160 may be fixed integrally.

Figure 18:
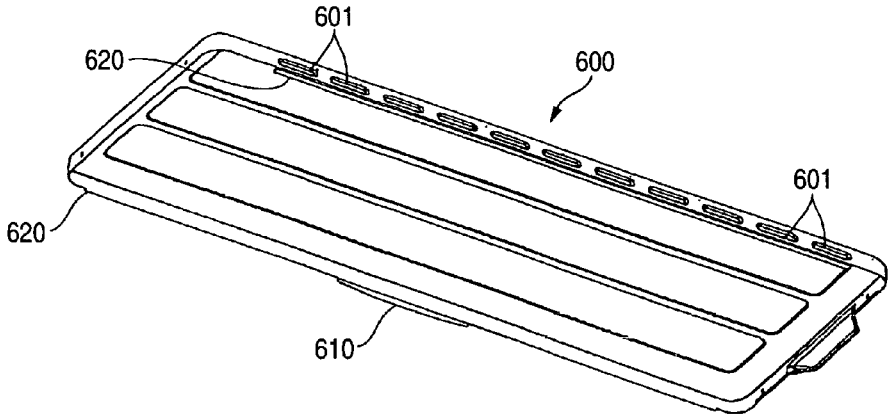
FIG. 18 is a perspective view illustrating a state in which the top panel is viewed from the bottom surface side in accordance with the exemplary, non-limiting embodiment.

FIG. 18 is a perspective view of the state in which the top panel 600 is viewed from the reverse side (lower side). The top panel 600 is formed in the shape of a rectangular pan for covering upper end sides of the side panels 300 and 400 and the front panel 500.

An air intake grille 601 for sucking air toward the heat exchanger 2 is formed on the reverse surface side of the top panel 600. The reinforcing piece 610, which is inserted into the insertion groove 560 of the front panel 500, is provided on the front surface of the top panel 600. The reinforcing piece 610 includes a tongue piece formed on the lower end side in the center of the front surface of the top panel 600.

Retaining ribs 620, which are retained by portions of the side panels 300 and 400, are provided on the reverse surface side of the top panel 600. The retaining ribs 620 are constituted by plate-like pieces bent substantially orthogonally from end portions on the reverse surface side of the top panel 600 toward the inner side.

Figure 19:
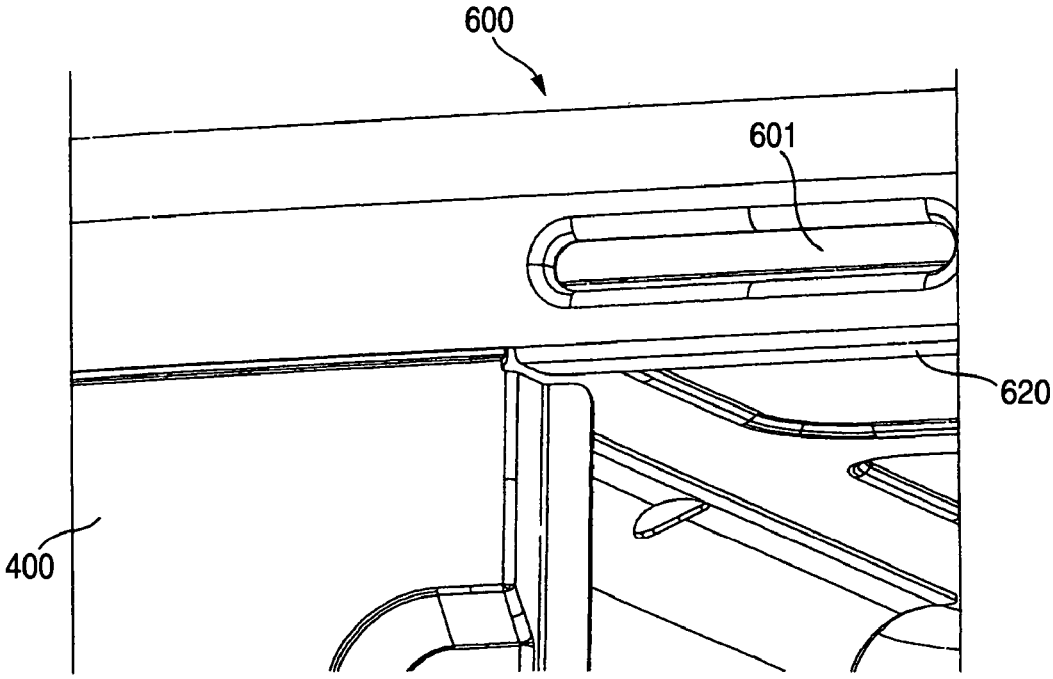
FIG. 19 is a partially enlarged rear perspective view for explaining the state of retention between the top panel and the side panel in accordance with the exemplary, non-limiting embodiment.

According to this arrangement, as shown in FIG. 19, the end portion of each retaining rib 620 and the end portion of each of the guide ribs 350 and 440 of the side panels 300 and 400 are opposed to each other with a clearance. Therefore, the side panels 300 and 400 and the top panel 600 can be assembled more firmly, and the positioning of the fitting position of the top panel 600 can be effected at the substantially same time.

Next, a description will be given roughly of one exemplary, non-limiting embodiment of the assembling procedure of this outdoor unit body 100. The partition plate 110 and the motor mounting base 130 have been installed in advance on the base panel 200, and that the compressor 1, the heat exchanger 2, the blow fan 3, and the electrical equipment box 4 have been assembled therein.

First, the side panels 300 and 400 are fitted on this base panel 200. Either one of the side panels 300 and 400 may be fitted first, but in this example a description will be given of a case in which the left side panel 300 is fitted first.

As shown in FIG. 10, the supporting rib 340 provided on the lower end side of the left side panel 300 is caught on the left side end of the base panel 200. Concurrently, in a state in which the left side panel 300 is set substantially vertically, the retaining hooks 351 are caught on the upper end of the side plate 23 of the heat exchanger 2 to thereby temporarily fix the left side panel 300.

Next, the right side panel 400 is installed. As shown in FIG. 13, the supporting rib 340 provided on the lower end of the right side panel 400 is first caught on the right side end face of the base panel 200. Next, in a state in which the right side panel 400 is set substantially vertically, the temporarily fixing rib 49 of the electrical equipment box 4 is inserted into the temporarily fixing insertion hole 450 of the right side panel 400 to temporarily fix the right side panel 400.

As a result, the side panels 300 and 400 are temporarily fixed to the base panel 200 by the holding means, and do not fall even if an operator releases his or her hands. Accordingly, the front panel 500 is then installed. In installing the front panel 500, the operator first manually holds the front panel 500, and fits it into the opening between the side panels 300 and 400.

At this time, if the widthwise position of the front panel 500 is offset, the guide ribs 530 and 540 abut against the end portions of the side panels 300 and 400 to guide the front panel 500 to a proper position along their tapered surfaces 531 and 541.

Upon confirming that the widthwise position is aligned, the operator inserts the retaining pawls 520 of the front panel 500 into the retaining holes 330 and 430 of the side panels 300 and 400. After confirming that the retaining pawls 520 have entered the retaining holes 330 and 430, the front panel 500 is slid downwardly, thereby allowing the retaining pawls 520 to be caught in the retaining holes 330 and 430.

After fixing the front panel 500 by allowing it to be caught by the respective side panels 300 and 400, the clamping surface 550 of the front panel 500 is then clamped from above by the clamping portion 160 of the motor mounting base 130 and is fitted thereto, as shown in FIG. 5.

Finally, the top panel 600 is fitted. The top panel 600 is placed in such a manner as to cover the upper ends of the side panels 300 and 400 and the front panel 500. The fitting position can be determined by the guide ribs 350 and 440 provided on the upper ends of the side panels 300 and 400.

The reinforcing piece 610 of the top panel 600 is inserted into the insertion groove 560 of the front panel 500. Consequently, the front panel 500 is completely fixed. Finally, the unillustrated threaded holes provided in the top panel 600 and the unillustrated threaded holes in the side panels 300 and 400 are positioned and affixed. The above-described series of process completes the outdoor unit body 100.

Since the connection of the refrigerant pipe and various cables for functioning the outdoor unit body 100 is known by those skilled in the art, description thereof is omitted.

While the invention has been described above with reference to the embodiment, the technical range of the invention is not restricted to the range described in the embodiment. It is apparent to the skilled in the art that various changes or improvements can be made in the embodiment. It is apparent from the appended claims that the embodiment thus changed or improved can also be included in the technical range of the invention.

What is claimed is:

1. An outdoor unit body of an air conditioner having a compressor, an electrical equipment box, a heat exchanger, and a blow fan, the outdoor unit body comprising:

a base panel on a contacted surface;

a left side panel and a right side panel positioned upright on the base panel;

a front panel on a front side of the outdoor unit body;

a top panel on upper end sides of the left side panel, the right side panel and the front panel, and a motor mounting base that supports a fan motor of the blow fan, the motor mounting base extending substantially upright from the base panel, and a first retainer that connects the front panel to the motor mounting base from above the front panel and the motor mounting base, wherein the side panels are metal, the front panel is a synthetic resin molded product, and front ends of the left side panel and the right side panel each have a bent shape substantially at a corner of the base panel, wherein the motor mounting base includes:

a main frame adapted to support the fan motor of the blow fan, said main frame extending substantially vertically from the base panel, and having a lower end connected to the base panel and an upper end spaced upwardly from the base panel, and a reinforcing frame having a first end connected to the upper end of the main frame and a second end connected to the front panel by the first retainer, said reinforcing frame extending substantially parallel to the top panel, wherein the first retainer comprises a clamping portion that clamps the upper end of the front panel.

2. The outdoor unit of an air conditioner according to claim 1, further comprising:

a partition plate that partitions an interior of the outdoor unit body into a first chamber including the compressor and the electrical equipment box, and a second chamber including the heat exchanger and the blow fan, wherein the front panel has an integral supply grille for the blow fan and a decorative panel covering the first chamber, and a second retainer is provided between the front panel and each of the left side panel and the right side panel.

3. The outdoor unit of an air conditioner according to claim 2, wherein the second retainer comprises: a retaining pawl on one of (a) each of side ends of the front panel and (b) each of the left side panel and the right side panel, and a retained portion opposing the retaining pawl, and wherein the retaining pawl is caught by the retained portion, and a clearance is provided between the retaining pawl and the retained portion.

4. The outdoor unit of an air conditioner according to claim 2, wherein a third retainer is positioned between the front panel and the top panel.

5. The outdoor unit of an air conditioner according to claim 4, wherein an insertion hole is provided in one of (a) an upper end of the front panel and (b) the top panel of the third retainer, and a retaining piece is provided in another one thereof, and wherein the retaining piece is inserted into the insertion hole.

6. The outdoor unit of an air conditioner according to claim 1, wherein a portion of the motor mounting base is supported by the heat exchanger.

7. The outdoor unit of an air conditioner according to claim 1, wherein threaded holes are respectively provided coaxially in, and integrally screwed down with respect to, the motor mounting base, the front panel, and the top panel.

8. The outdoor unit of an air conditioner according to claim 4, wherein a retaining position of the first retainer overlaps a retaining position of the third retainer.

9. The outdoor unit of an air conditioner according to claim 1, wherein the front panel includes a first portion having a first width that is greater than a width of an opening between the side panels, such that the first portion overlaps the left side panel and the right side panel, and the front panel includes a second portion projecting from the first portion into the air conditioner, the second portion including oppositely arranged abutment surfaces each oriented transversely to the first portion, the abutment surfaces defining a second width between the abutment surfaces that is less than the width of the opening between the side panels, wherein the abutment surfaces each oppose an end of the respective left side panel and the right side panel, such that a clearance is provided between each abutment surface and the end of the respective left side panel and right side panel.

* * * * *